US005502991A

United States Patent [19]

Sørnes

[11] Patent Number: 5,502,991

[45] Date of Patent: Apr. 2, 1996

[54] LOCK CYLINDER WITH VARIABLE KEYWAY PROFILE

[75] Inventor: Tor Sørnes, Moss, Norway

[73] Assignee: TrioVing AS, Norway

[21] Appl. No.: 273,795

[22] Filed: Jul. 12, 1994

[30] Foreign Application Priority Data

Jul. 13, 1993 [NO] Norway ..... 932544

[51] Int. Cl.[6] ..... E05B 15/08

[52] U.S. Cl. ..... 70/453; 70/384; 70/407; 70/420; 70/494

[58] Field of Search ..... 70/493–496, 382, 70/384, 385, 386, 346, 347, 358, 356, 376, 453, 454, 378, 392, 407, 409, 419–421

[56] References Cited

U.S. PATENT DOCUMENTS

| | | | |
|---|---|---|---|
| 9,787 | 7/1881 | Schade | 70/453 X |
| 446,176 | 2/1891 | Shaw | 70/453 |
| 4,231,242 | 11/1980 | Hill et al. | 70/347 |
| 4,296,618 | 10/1981 | Guiraud | 70/407 X |
| 4,356,713 | 11/1982 | Widen | 70/419 X |
| 4,608,842 | 9/1986 | Tietz | 70/378 X |
| 4,653,298 | 3/1987 | Tietz | 70/409 X |
| 5,088,306 | 2/1992 | Field | 70/453 X |
| 5,174,141 | 12/1992 | Ohyabu | 70/419 X |

FOREIGN PATENT DOCUMENTS 469565 7/1993 Sweden .

*Primary Examiner*—Lloyd A. Gall
*Attorney, Agent, or Firm*—Lucas & Just

[57] ABSTRACT

The lock cylinder comprises a cylinder body wherein a cylinder plug (1) comprising a slot (2) for the key (18) of the lock is rotatable arranged. The profile of the key slot and therefore also of the key is determined by profile forming elements in the form of rotation bodies (6,7) which are inserted in bores (4,5) extending through the cylinder plug (1) parallel to and adjacent to the middle plane (10) of the key slot (2). The profile elements (6,7) may be made of hardenable steel, for instance by turning, and may comprise a number of portions of different diameters so that the total number of key profiles obtainable becomes high while permitting the key profile to be made very thin and correspondingly difficult to copy.

12 Claims, 2 Drawing Sheets

LOCK CYLINDER WITH VARIABLE KEYWAY PROFILE

The present invention relates to lock cylinders and to keys used in the lock cylinders.

It is known to make the cylinder plug for different key profiles as an element or a major part of a lock system. Also, for other reasons such as safety considerations, it is desirable to make many different profiles. The larger the number of different profiles, the higher the number of key variations that can be made.

The most common method for making key hole profiles today is to broach the channel with a toothed steel broach in a machine made especially for this purpose. The broach is often about one meter long and is driven through the cylinder plug while the teeth on the broach are cutting chips from the cylinder plug. This method has many drawbacks and deficiencies but is nevertheless the method most widely used today.

Among the drawbacks are that the machine and broach are relatively expensive equipment. The long broaches are also cumbersome to replace in the machine and there is therefore a limit to the practicable number of different profiles (broaches) available.

Another deficiency is that the key slot must have a certain minimum cross-section at all points determined by the strength of the teeth of the broach. The profile of the key slot is also in other respects shaped in accordance with the limits of the broach. For instance, the pitch angle of the grooves of the profile must be such that abrupt cross-sectional changes are avoided. If the profile has abrupt cross-sectional changes, the teeth of the broach will easily break. In other words, the shape is governed by the tools and method rather than the desired function.

There have been a number of suggestions aimed at avoiding the above drawbacks by placing exchangeable profile determining elements at the front of the cylinder plug. However, none of these suggestions have been found to have industrial applicability to any notable extent.

Thus, from U.S. Pat. No. 4,231,242 there is known a lock cylinder wherein the key profile fitting the key slot is determined by two studs installed with force fits in bores extending transversely to the key slot, said studs extending some distance into the key slot from either side. The installation of these studs is cumbersome, e.g. because it requires special measures for determining exactly how far into the key slot the studs are to extend and because those parts of the studs that are left on the outside of the cylinder plug after installation must be ground away. The studs cannot later be moved if one subsequently wishes to change the profile of the key; instead, one has to install a further stud in a reserve bore. The possibilities for a later change to other key profiles are therefore quite limited and the same holds for the total number of possible key profile varieties. A further drawback is that the access to the key slot for common picking tools is not particularly difficult.

From Swedish Patent No. 469565 a cylinder lock is known wherein the tumbler pins acted upon by the key lie to the side of the middle plane of the key slot and are provided with a circular flange cooperating with a slot in the side face of the key, said slot acting to lift the tumbler pins to an extent depending upon the combination of the lock. These tumbler pins cannot be used to change the profile of the key and they restrict the cross-section of the key slot to such a small degree that picking tools have fairly easy access.

The purpose of the present invention is to provide a lock cylinder which can be manufactured in an effective and cost efficient manner and which makes it easy to change the profile of the key while making it very difficult for the lock to be accessed by picking tools.

This is achieved according to the invention by employing two profile elements having varying diameters along a major portion of their lengths and being arranged substantially parallel to and near the middle plane of the key slot. The two profile elements are also arranged such that one of said two profile elements is on the opposite side of the key slot from the other one of said two profile elements. Thus, the key interacts with both profile elements when it enters the key slot and must be able to pass by both elements in order for the cylinder to rotate. Since the profile elements are easily made in a great number of varieties and with quite abrupt cross-sectional changes, the number of possible key varieties becomes very high, and the key opening between the profile elements may in one or more portions be made so narrow and irregular that picking tools cannot pass. Furthermore, the key profile of the lock can very simply be changed by exchanging the profile elements or by switching the profile elements around. Additionally, keys can be made that are very difficult to copy for unauthorized persons, this also being an important improvement as compared to the keys used today.

Broadly, the lock cylinder of the present invention comprises a cylinder body wherein a cylinder plug is rotatable arranged, said cylinder plug being provided with bores for tumbler pins and a slot for the key belonging to the lock cylinder, said key slot having at least one portion provided with a cross-sectional profile which is adapted to the profile of the key, said cross-sectional profile at least partly being formed by two profile elements constituted by rotatable bodies arranged axially immovably in bores in the cylinder plug substantially on either side of the middle plane of the key slot, and wherein the profile elements have varying diameters along a major portion of their lengths and are arranged substantially parallel to and near the middle plane of the key slot.

Further advantageous features of the invention which are directed to the lock cylinder itself include one or more of the following elements:

(a) the bores can be offset with respect to each other in the longitudinal direction of the cylinder plug;

(b) the profile elements can be arranged spaced from the opening of the key slot;

(c) two further bores for a second pair of profile elements can be arranged behind said first pair of bores for the profile elements;

(d) the profile elements can have rounded end surfaces which have a radius of curvature less than the radius of the cylinder plug and which generally abut the inner periphery of the cylinder body;

(e) the profile elements can have a larger diameter than the tumbler pins of the cylinder plug;

(f) the largest diameter of the profile elements can be about twice the thickness of the corresponding key; and (g) the profile elements can be made of hardened steel.

The invention also relates to a key fitting the lock cylinder according to the invention. Some of the features of the key for use in the present invention are characterized in that the key bit has a narrow web portion which interconnects a middle and a lower flange portion, said web portion having a height (h) which is between about ⅓ and about ¼ of the total height (H) of the key bit and a thickness (t) which is between about 1/6 and about 1/10, and more preferably about 1/8, of the largest thickness (T) of said flange portions. Additionally, the key of the present invention is characterized in that said web portion is intersected by the middle plane of the key bit in at least one or, more preferably, in a plurality of places.

For better understanding of the invention, it shall be described more closely with reference to the exemplifying embodiments shown in the drawings wherein.

In the various figures, like or corresponding parts are given the same reference numerals.

Figure 1:
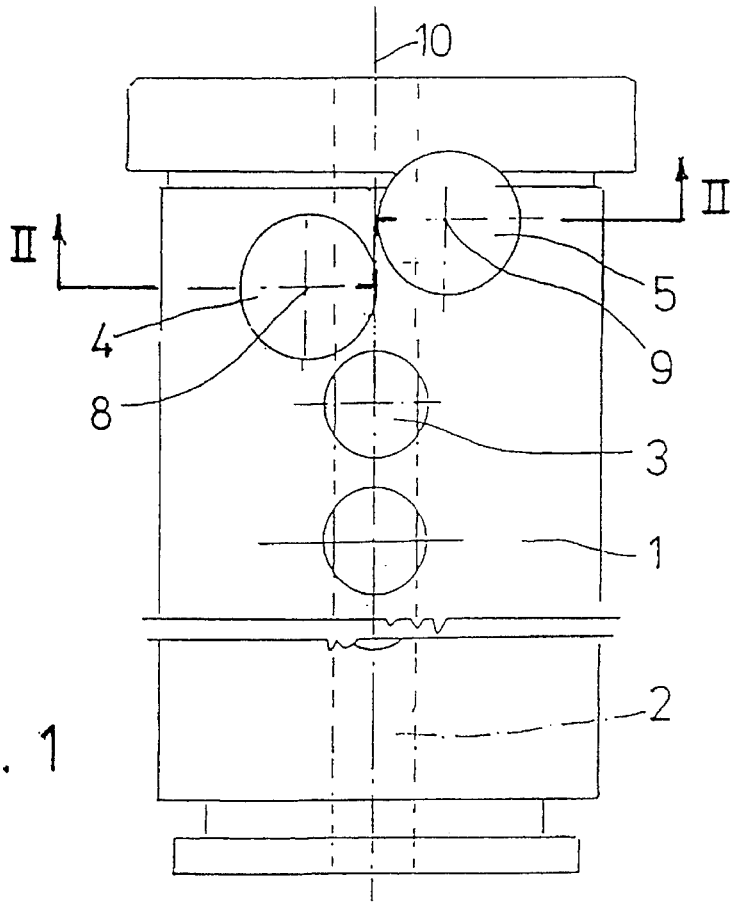
FIG. 1 shows a cylinder plug according to the invention viewed from above, without tumbler pins and profile elements.

The cylinder plug 1 shown in FIG. 1 is provided with a longitudinal key slot 2 having a generally rectangular cross-section. The plug has bores 3 for the usual tumbler pins and bores 4 and 5 for the key slot profile forming elements of the plug.

Figure 2:
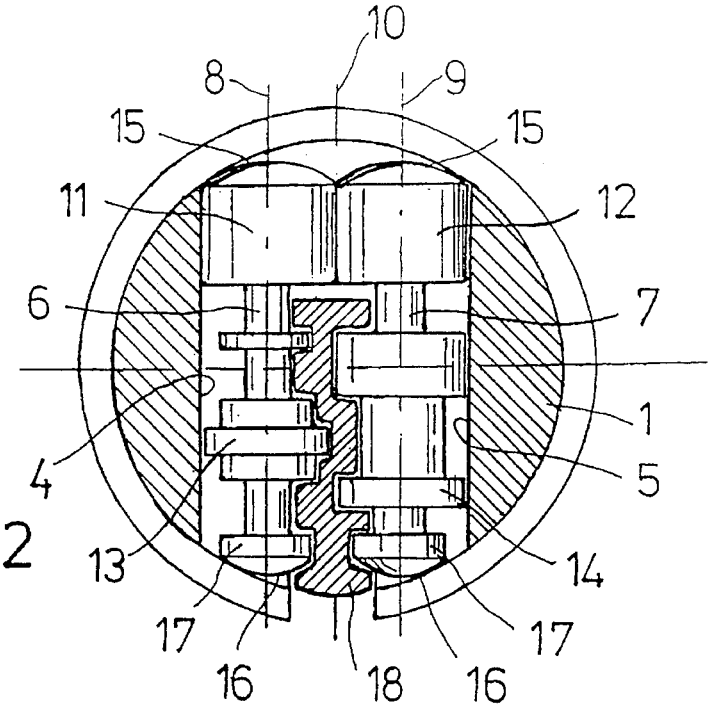
FIG. 2 is a section along line II—II of FIG. 1, with the profile elements in place and a key introduced into the plug.

FIG. 2 shows the shape of the profile forming elements 6,7. They are in the form of rotatable bodies having varying diameters. They are preferably made by turning of a hardenable steel. It will be understood that other methods of manufacture may be used, for instance hard metal sintering.

The bores 4,5 for the profile elements 6,7 are arranged with their axes 8,9 parallel to the middle plane 10 of the key slot and are generally equidistant from the middle plane. As may be seen from FIG. 1, however, the bores 4,5 are arranged offset with respect to each other in a longitudinal direction of the plug. This contributes, inter alia, to maintaining the strength of the plug in this area and facilitates placing the bores adjacent to the middle plane of the key slot without the bores coming into direct contact with each other.

At one end the profile elements 6,7 have a straight cylindrical portion 11 and 12, respectively, which fits with little clearance in the respective bores 4,5. This cylindrical portion provides sufficient lateral support for the profile element but, for reasons of mechanical strength, the profile elements should preferably have at least one further portion with the full diameter closer to the other end, for instance like the portions 13 and 14 shown in FIG. 2.

The bores 4,5 for the profile elements are through-going and the profile elements have rounded end surfaces 15,16, the radius of curvature of which is less than the radius of the cylinder plug 1. The end surfaces 15,16 can therefore generally contact and abut against the inner periphery (not shown) of the cylinder body so that further axial restraint of the profile elements becomes unnecessary. The through-going bores will make it easy to replace the profile elements after the cylinder plug has first been pulled somewhat out of the cylinder body.

At their lower ends the profile elements have a portion 17 of reduced diameter which, together with the rounded end surface 16, permits a portion of full width at the lower part of the key 18. This may be of importance for the strength of the key when the remaining part of the profile is narrow, as in the embodiment shown in FIG. 2.

It will be apparent that the diameter of the bores 4,5 for the profile elements is larger than the diameter of the bores 3 for the tumbler pins. The diameter of the former bores may be about twice the thickness of the key 18. The profile elements may thus be shaped to take advantage of the full thickness of the key without their narrowest portions becoming too weak.

Figure 3:
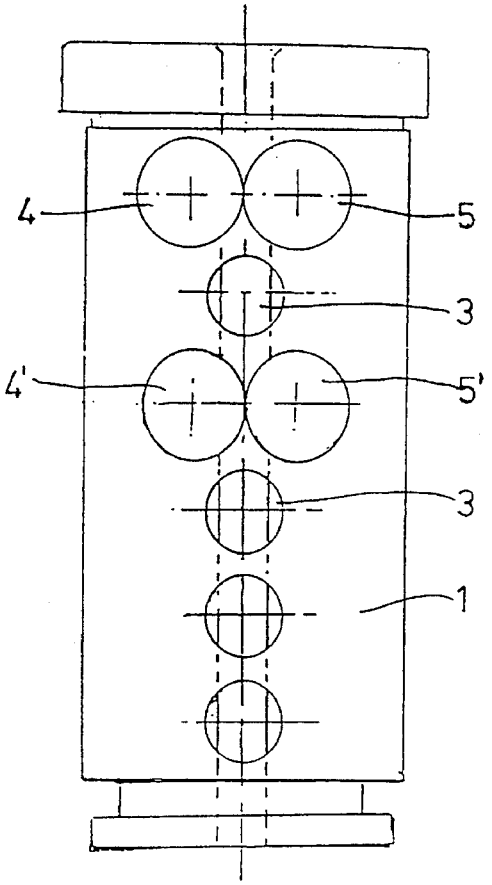
FIG. 3 shows an alternative embodiment of the cylinder plug.

As is easily seen from FIG. 3, the profile elements can be manufactured with a multitude of profiles so that a large variety of keys may be used. If, for example, ten different profiles for each of the two profile elements 6,7 are available, 100 key profiles (10×10) may be obtained.

In FIG. 3 an alternative embodiment of the cylinder plug 1 is shown. Here, the bores 4,5 for the profile elements are placed adjacent to each other along the middle plane 10 of the key slot, and two further bores for a second pair of profile elements are arranged inwardly of or behind the first bores with a tumbler pin bore 3 inbetween. By means of this construction the access to the innermost tumbler pins with a picking tool is very effectively prevented. The two pairs of profile elements may be identical, or they may be different and together define the key profile. In the latter case, the key profile can be given a very intricate form without the profile elements becoming correspondingly difficult to manufacture.

Figure 7:
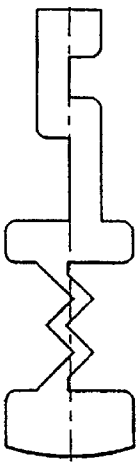

FIGS. 4–7 illustrate four different embodiments of the profile of the key bit 19 of the key 18 according to the invention. The key bit comprises a lower flange 20 and a middle flange 21 which are interconnected by a narrow web portion 22. The web portion has a height h which is preferably between 1/3 and 1/4 of the total height H of the key bit. The narrow web portion 22 has a thickness t which is preferably between 1/6 and 1/10 of the largest thickness T of the flanges 20,21, and is more preferably about 1/8 of this thickness. It will be apparent that the narrow web portion 22 is intersected by the middle plane of the key bit once in FIG. 6, twice in FIGS. 4 and 5 and four times in FIG. 7. In addition to the part of the key slot in the cylinder plug 1 corresponding to the web portion of the key bit being very narrow, the irregular form of this part of the slot will make it practically impossible to introduce a picking tool into the cylinder plug. The zigzag form in FIG. 7 is especially effective in this respect.

Even though the narrow web portion 22 is very thin and has a considerable height, the key nevertheless becomes strong enough because the web, together with the two flanges 20,21, forms an approximate I-beam profile.

Figure 8:
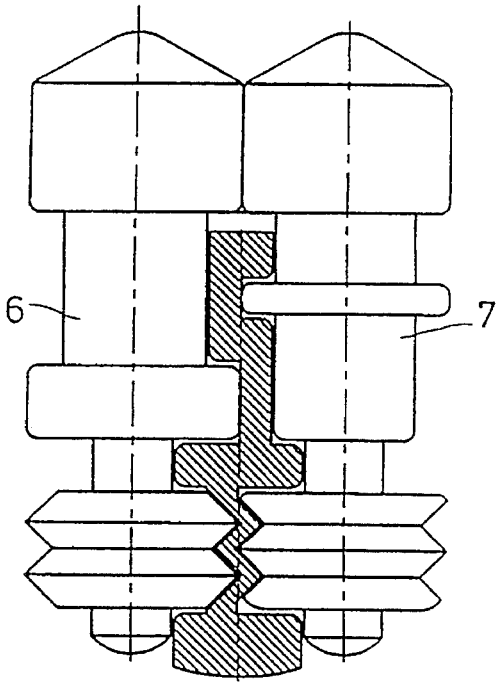
FIG. 8 shows the key profile of FIG. 7 with the two profile elements forming the corresponding key slot.
Figure 4:
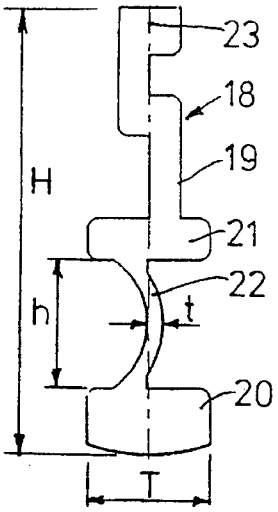
FIGS. 4–7 show various key profiles.
Figure 5:
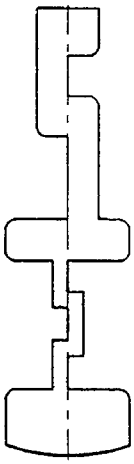
Figure 6:
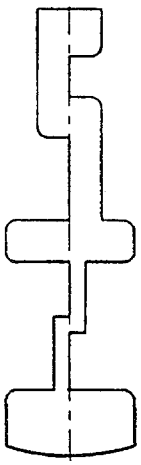

FIG. 8 shows the shape of the two profile elements 6,7 forming the key slot for a key having a profile as shown in FIG. 7.

It will be understood that the invention is not restricted to the exemplifying embodiments shown but may be varied in a number of ways within the scope of the appendant claims.

What is claimed is:

1. A lock cylinder comprising a cylinder body wherein a cylinder plug (1) is rotatably arranged, said cylinder plug being provided with bores (3) for tumbler pins and comprising a slot (2) for a key (18) belonging to the lock cylinder, said key slot (2) having at least one portion provided with a cross-sectional profile which is adapted to the profile of the key, said cross-sectional profile at least partly being formed by two profile elements (6,7) constituted by bodies that are rotatable relative to the plug and are arranged axially immovably in bores (4,5) in the cylinder plug (1) substantially on either side of a middle plane (10) of the key slot, said profile elements (6,7) having varying diameters along a major portion of their length and being arranged substantially parallel to and near the middle plane (10) of the key slot (2).

2. A lock cylinder according to claim 1, wherein the bores (4,5) are offset with respect to each other in the longitudinal direction of the cylinder plug (1).

3. A lock cylinder according to claim 1, wherein the profile elements (6,7) are arranged spaced from an opening of the key slot (2).

4. A lock cylinder according to claim 1, further comprising two further bores (4',5') for a second pair of profile elements arranged behind said bores (4,5) for the profile elements.

5. A lock cylinder according to claim 1, wherein the profile elements (6,7) have rounded end surfaces (15,16) which have a radius of curvature less than the radius of the cylinder plug (1) and which generally abut the inner periphery of the cylinder body.

6. A lock cylinder according to claim 1, wherein the profile elements (6,7) have a larger diameter than the tumbler pins (3) of the cylinder plug (1).

7. A lock cylinder according to claim 1, wherein the largest diameter of the profile elements (6,7) is about twice the thickness of the corresponding key (18).

8. A lock cylinder according to claim 1, wherein the profile elements (6,7) are made of hardened steel.

9. A lock cylinder according to claim 1 further comprising a key, said key comprising a key bit (19) for the introduction into the key slot formed between the profile elements (6,7) in the cylinder plug (1), said key bit (19) having a narrow web portion (22) which interconnects a middle and a lower flange portion (21,20), said web portion (22) having a height (h) which is between about ⅓ and about ¼ of the total height (H) of the key bit (19) and a thickness (t) which is between about ⅙ and about 1/10 of the largest thickness (T) of said flange portions (20,21).

10. A lock cylinder according to claim 9 wherein the thickness (t) of the web portion (22) is about ⅛ of the largest thickness (T) of said flange portions (20,21).

11. A lock cylinder according to claim 9 wherein said web portion (22) is intersected by a middle plane (23) of the key bit (19) in at least one place.

12. A lock cylinder according to claim 9 wherein said web portion (22) is intersected by a middle plane (23) of the key bit (19) in a plurality of places.

* * * * *